US006406166B1

(12) United States Patent
Ko

(10) Patent No.: US 6,406,166 B1
(45) Date of Patent: Jun. 18, 2002

(54) CHASING ROPE LIGHT

(76) Inventor: Yu-Chow Ko, 1 Dynasty Heights 8 Yin Ping Road, Kowland, Hong Kong (CN)

( * ) Notice: Subject to any disclaimer, the term of this patent is extended or adjusted under 35 U.S.C. 154(b) by 0 days.

(21) Appl. No.: 09/580,975

(22) Filed: May 30, 2000

(51) Int. Cl.[7] ..... H05B 37/00

(52) U.S. Cl. ..... 362/249; 362/219; 362/252; 362/806; 362/800; 315/185 S; 315/185 R

(58) Field of Search ..... 362/249, 219, 362/252, 806, 227, 800; 315/185 S, 185 R

(56) References Cited

U.S. PATENT DOCUMENTS 4,994,944 A * 2/1991 Vernondier ..... 362/238
5,315,160 A * 5/1994 Chang ..... 315/185 S
5,854,541 A * 12/1998 Chou ..... 315/185 S
5,957,564 A * 9/1999 Bruce et al. ..... 362/84

* cited by examiner

*Primary Examiner*—Thomas M. Sember
(74) *Attorney, Agent, or Firm*—Raymond Y. Chan; David and Raymond Patent Group

(57) ABSTRACT

A chasing rope light includes a flexible core tube, a pair of conductive wires longitudinally extended along the core tube and a pair of illuminating units. Each unit has at least an illuminator and a diode electrically connected together in series and disposed in the core tube. The illuminating units are electrically connected with the conductive wires in parallel such that when a current is applied to the conductive wires, the current is rectified by the diodes so as to alternately pass through the illuminating units for illuminating the illuminators thereof.

2 Claims, 5 Drawing Sheets

CHASING ROPE LIGHT

BACKGROUND OF THE PRESENT INVENTION

1. Field of Invention

The present invention relates to rope light, and more particularly to a chasing rope light which is adapted to minimize the use of the wire, so as to maintain a multi-circuit of the rope light for performing various lighting effects such as chasing and fading effect. So, the chasing rope light can not only minimize the cost of the wire but also highly reduce the thickness of the chasing rope light.

2. Description of Related Arts

A rope light is a rope like structure containing a number of lights, such as sub-miniature light bulbs or LEDs, embedded in a PVC tube which lined up by electrical wires.

As shown in FIG. 1, a conventional rope light A1 comprises a hollow PVC core tube A11 coated and surrounded with an outer cover layer A12, three electrical wires A13, A14, A15 longitudinally extended along the core tube A11 and disposed inside the cover layer A12, and a pair of illuminating units A16, A17 each having a plurality of illuminators A18 electrically connected together in a serial connection, wherein the illuminating units A16, A17 are longitudinally disposed in the core tube A11 and electrically and selectively connected to the wires A13, A14, A15 at two ends of the core tube A11 in such a manner that when the rope light A1 is switched on, the illuminators A18 of the illuminating units A16, A17 are selectively lightened and provided a diversified lighting effects.

Referring to FIG. 2A, as it is mentioned above, the rope light A1 is connected as a single-circuit. If the rope light A1 is connected as a double-circuit or multi-circuit, more wires are needed to be connected with the illuminating units. For example, four wires A13, A14, A15, and A19 are needed to selectively connected. with three illuminating units A16, A17, A20, as shown in FIG. 2B, for double-circuit of the rope light A1'. So, as to meet the market trend, to perform more lighting effects, the more circuits for the rope light are needed. In other words, more wires are needed for the rope light to perform more lighting effects.

However, the thickness of the rope light will be increase due to the increase of the wire, which is definitely reduced the flexibility of the rope light. If the rope light could be operated on the less of wires to maintain multi-circuit for performing various lighting effects such as chasing and fading effects, both the cost of the wire and the thickness of the rope light will be highly reduced. For instance, the cost of the wire used in the rope light would be reduced up to 25 percent.

SUMMARY OF THE PRESENT INVENTION

A main object of the present invention is to provide a chasing rope light which can provide more lighting effects without increasing the number of the tin wires.

Another object of the present invention is to provide a chasing rope light which can increase the flexibility of the chasing rope light by minimizing the number of electrical wires.

Another object of the present invention is to provide a chasing rope light wherein less tin wires are used so as to highly decrease both the cost of the tin wire and the thickness of the chasing rope light.

Another object of the present invention is to provide a chasing rope light wherein the original structure of -the chasing rope light is much simple than that of the conventional one, which can minimize the manufacturing cost of the present invention.

Accordingly, in order to accomplish the above objects, the present invention provides a chasing rope light, comprising:

an elongated core tube;

a first and a second conductive wire are longitudinally extended along the core tube;

a connector means for electrically connecting the conductive wires to a power source; and a first and a second illuminating unit, each comprising at least an illuminator and a diode electrically connected together in series and disposed in the core tube for securely holding the illuminators in position, wherein both first ends of the first and second illuminating units are electrically connected to the first conductive wire in parallel and both second ends of the first and second illuminating units are electrically connected to the second conductive wire in parallel, wherein the diode of the first illuminating unit and the other diode of the second illuminating unit are arranged in opposite direction that when a current is applied to the first and second conductive wires, the first diode of the first illuminating unit enables the current flowing from the first conductive wire to the second conductive wire via the first illuminating unit, and the second diode of the second illuminating unit enables the current flowing from the second conductive wire to the first conductive wire via the second illuminating unit.

DETAILED DESCRIPTION OF THE PREFERRED EMBODIMENT

Figure 1:
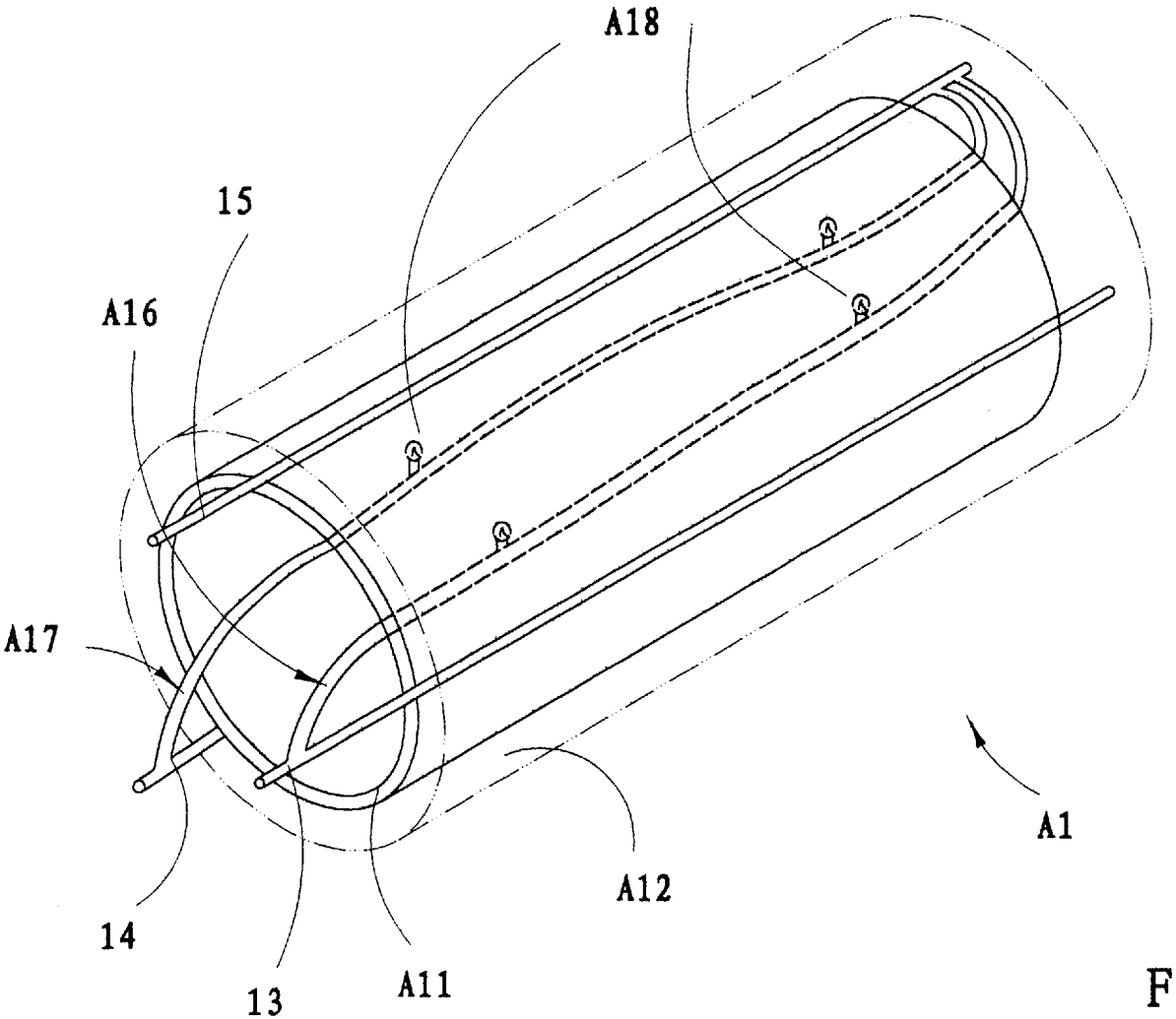
FIG. 1 is a perspective view of a convention rope light.
Figure 2A:
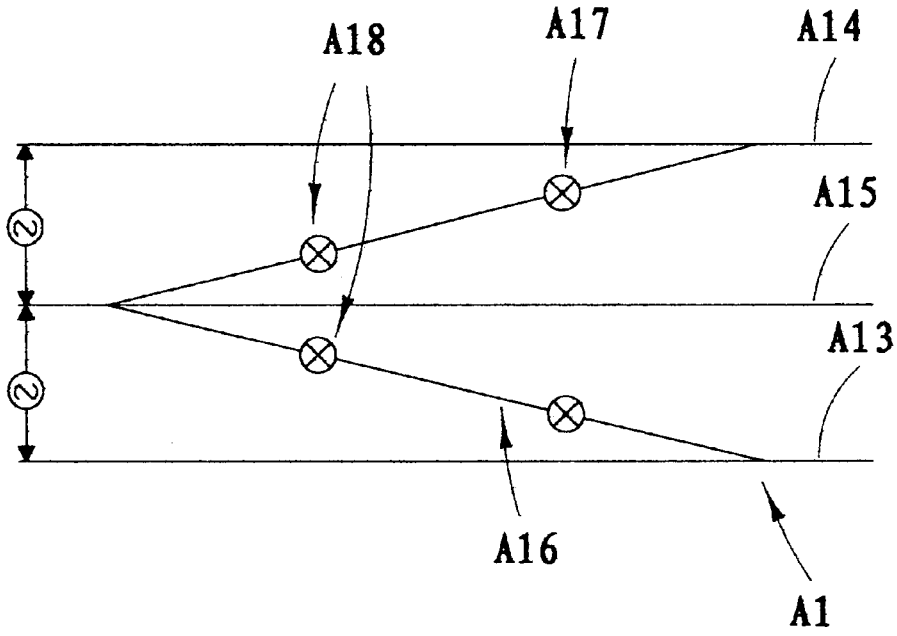
FIG. 2A is a single-circuit diagram of the convention rope light.
Figure 2B:
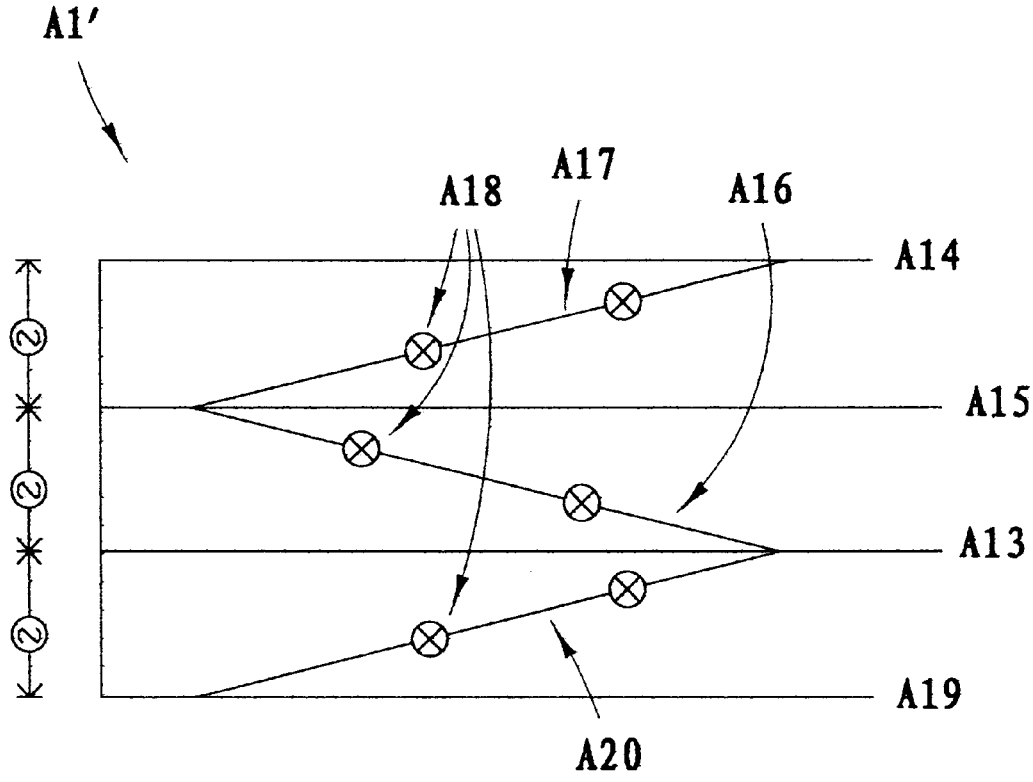
FIG. 2B is a double-circuit diagram of the convention rope light.
Figure 3:
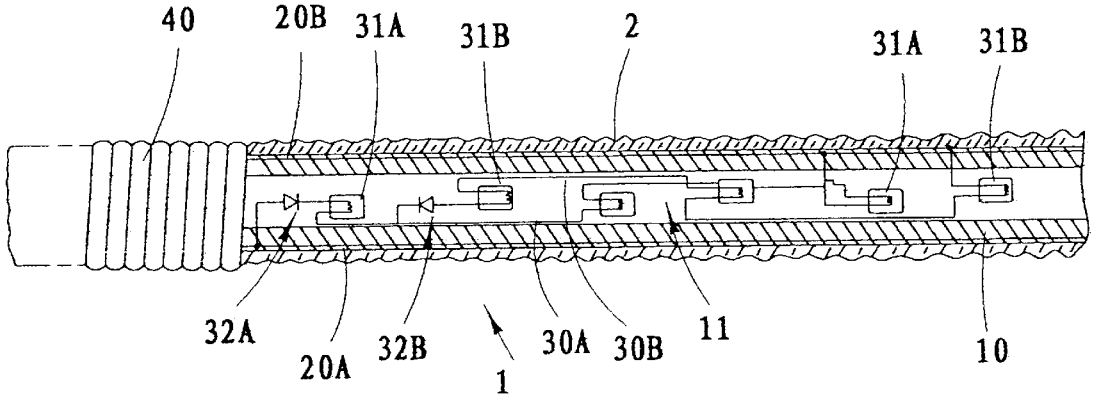
FIG. 3 is a sectional view of a chasing rope light according to a first preferred embodiment of the present invention.
Figure 4:
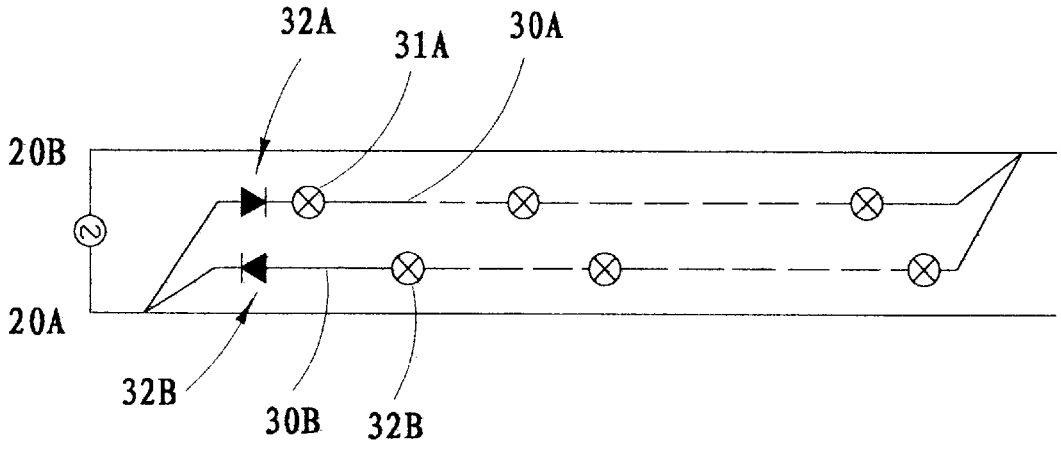
FIG. 4 is a circuit diagram of the chasing rope light according to the above first preferred embodiment of the present invention, illustrating the single-circuit of the chasing rope light.

Referring to FIGS. 3 and 4 of the drawings, a chasing rope light 1 according to a first preferred embodiment of the present invention is illustrated.

The chasing rope light 1 comprises an elongated core tube 10 having an axial tubular cavity 11 extended therein, a first and a second conductive wire 20A, 20B are longitudinally extended along an outer circumference of the core tube 10, a first and a second illuminating unit 30A, 30B, and a connector means 40 provided at one end of the core tube 10 for electrically connecting the conductive wires 20 to a power source.

The first and second illuminating units 30A, 30B, each of which comprises at least an illuminator 31A, 31B and a diode 32A, 32B electrically connected together in series, are disposed in the cavity 11 of the core tube 10 for securely holding the illuminating units 30A, 30B in position, wherein both first ends of the first and second illuminating units 30A, 30B are electrically connected to the first conductive wire 20A in parallel and both second ends of the first and second illuminating units 30A, 30B are electrically connected to the second conductive wire 20B in parallel.

Moreover, the first diode 32A of the first illuminating unit 30A and the second diode 32B of the second illuminating unit 30B are arranged in opposite direction that when a current is applied to the first and second conductive wires 20A, 20B, the first diode 32A of the first illuminating unit 30A enables the current flowing from the first conductive wire 20A to the second conductive wire 20B via the first illuminating unit 30A, and the second diode 32B of the second illuminating unit 30B enables the current flowing from the second conductive wire 20B to the first conductive wire 20A via the second illuminating unit 30B.

Moreover, the chasing rope light 1 further comprises an outer casing 2 seadedly encircling the outer circumference of the core tube 10 so as to cover the core tube 10 and the first and second conductive wires 20A, 20B for protecting the chasing rope light 1.

According to the preferred embodiment, the core tube 10 is hollow tube defining the elongated cavity 11 therein, wherein the core tube 10 is made of soft PVC (polyvinyl chloride) in such a flexible manner. Each conductive wire 20A, 20B which is a twisted tin wire is longitudinally extended along the outer circumference of the core tube 10. Each of the illuminators 31A, 31B is preferably a LED wherein the illuminator 31A, 31B is longitudinally disposed in the cavity 11 of the core tube 10, as shown in FIG. 3.

As shown in FIG. 4, the chasing rope light 1 is connected as a single-circuit. Each diode 32A, 32B of the illuminating unit 30A, 30B is adapted to rectify a direction of a current passing through the illuminating unit 30A, 30B. In other words, the diode 32A, 32B can only allow the current flow in one direction. So, the two diodes 32A, 32B connected to the two illuminating units 30A, 30A respectively allow opposite direction of the current flow into the illuminating units 30A, 30B.

For example, as shown in FIG. 4, the two sets of illuminating unit 30A, 30B each has the diode 32A, 32B operating in a reverse direction. When a current flows from the first conductive wire 20A to the second conductive wire 20B, the set of illuminating unit 30A will be lightened up since the current is only blocked by the diode 32B. While the current flows from the second conductive wire 20B to the first conductive wire 20A, the set of illuminating unit 30B will be lightened up because the current is only blocked by the diode 32A. When the conductive wires 20A, 20B are further electrically connected with a controller (not shown) which is adapted to provide different direction of the current to the illuminating units 30A, 30B, the illuminators 31A, 31B on the two set of the illuminating units 30A, 30B respectively will be alternatively lightened up in a sequence ABABA which is the chasing effect of the rope light 1. As it is mentioned in the background, the conventional rope light requires at least three conductive wires in order to provide the chasing effect, wherein the present invention requires only two conductive wires 20A, 20B.

Figure 5:
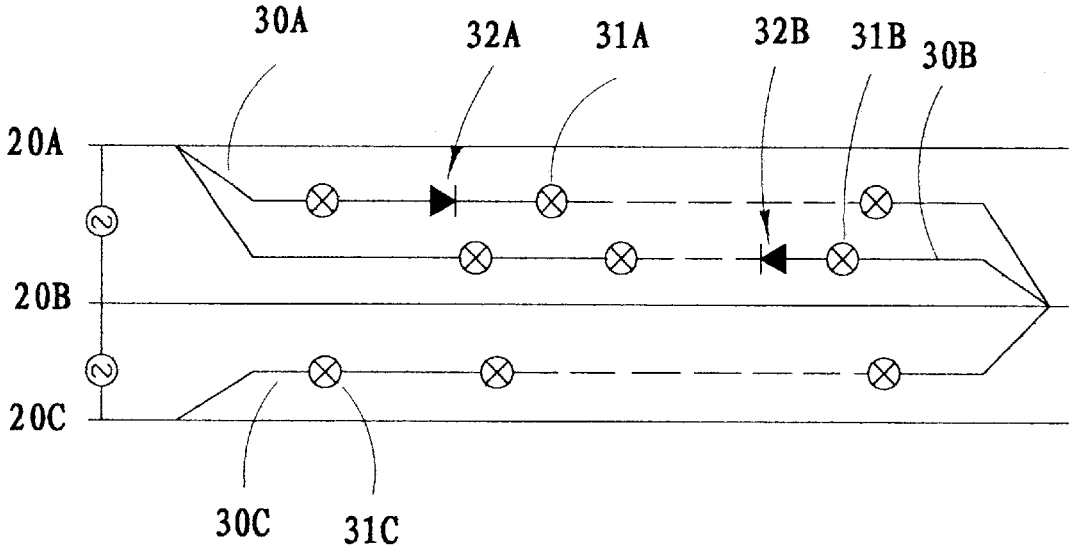
FIG. 5 illustrates a first alternative mode of the chasing rope light according to the above first preferred embodiment of the present invention, illustrating the double-circuit of the chasing rope light.

FIG. 5 illustrates a first alternative mode of the chasing rope light 1 according to the first preferred embodiment of the present invention, wherein the chasing rope light 1 is connected in a double-circuit arrangement. The chasing rope light 1 further comprises an additional third conductive wire 20C longitudinally extended along the core tube 10 such that three identical conductive wires 20A, 20B, 20C are evenly provided on the outer circumference of the core tube 10. The sets of illuminating units 30A, 30B are connected in parallel between the conductive wires 20A, 20B, wherein the third illuminating unit 30C which has no diode has one end connected to the second conductive wire 20B and another end connected to the third conductive wire 20C, wherein the current is adapted to flow along the third illuminating unit 30C in both directions since the third illuminating unit 30C has no diode 32 provided thereon.

When connecting with the controller (not shown) which provides different directions of the current between the conductive wire 20A and 20B, the illuminators 31A, 31B of the illuminating units 30A, 30B respectively will be lightened up alternately. Thus, when the current flows between the circuit of conductive wires 20A and 20B, and the circuit of conductive wires 20B and 20C, alternately, the illuminating units 30A, 30B, and 30C will be illuminated alternately for providing the chasing effect of the chasing rope light 1, which requires at least four conductive wires in order to provide the chasing effect in the conventional rope light.

Figure 6:
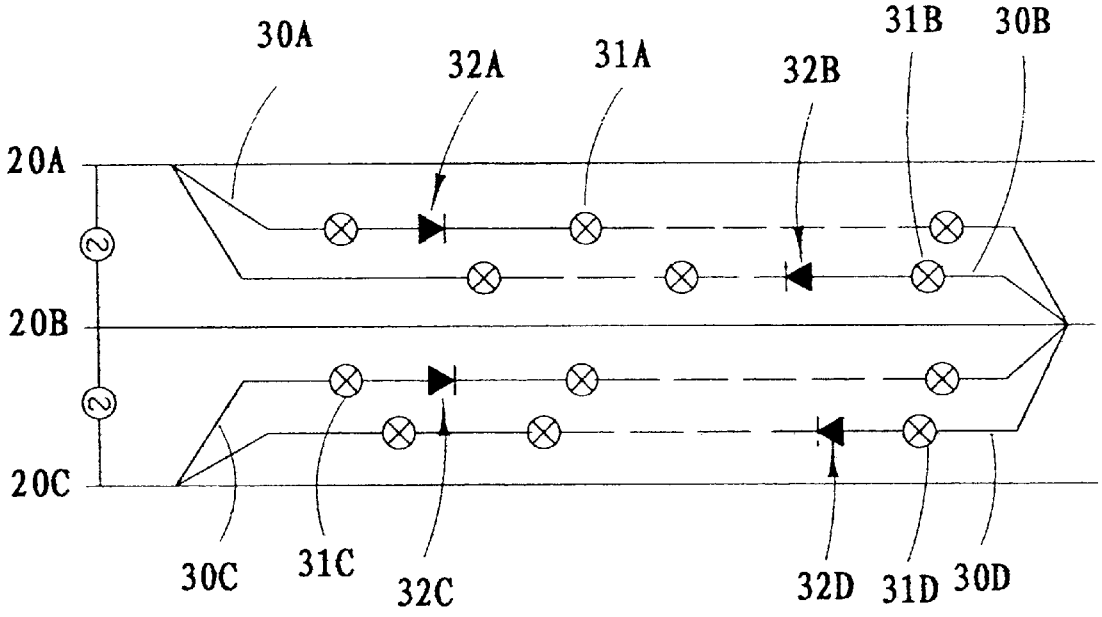
FIG. 6 illustrates a second alternative mode of the chasing rope light according to the above first preferred embodiment of the present invention, illustrating the multi-circuit of the chasing rope light.

FIG. 6 illustrates a second alternative mode of the chasing rope light 1 according to the first preferred embodiment of the present invention, wherein the chasing rope light 1 is connected in a multi-circuit arrangement. A first pair of illuminating units 30A, 30B are connected between the first and second conductive wires 20A, 20B in parallel circuit, and a second pair of illuminating units 30C, 30D are connected between the second and third conductive wires 20B, 20C in such a manner when connecting with the controller (not shown) which provides different directions of the circuit between the conductive wires 20A and 20B, the illuminators 31A, 31B of the illuminating units 30A, 30B respectively will be lightened up alternately. Meanwhile, when the controller provided different directions of the circuit between the conductive wires 20B and 20C, the illuminators 31C, 31D of the illuminating units 30C, 30D respectively will be lightened up alternately. So, by controlling the timing of the circuit between the conductive wires 20A and 20B, and the circuit between the second and third conductive wires 20B and 20C, the illuminators 31A, 31B, 31C, and 31D will be lightened up alternately. Comparing to the conventional rope light, the conventional rope light requires at least five conductive wires in order to provide a multi-circuit of the chasing effect. However, the present invention requires only three conductive wires 20A, 20B, 20C in the multicircuit arrangement, which can highly reduce the number of conductive wire, so as to decrease the thickness of the chasing rope light 1.

Figure 7:
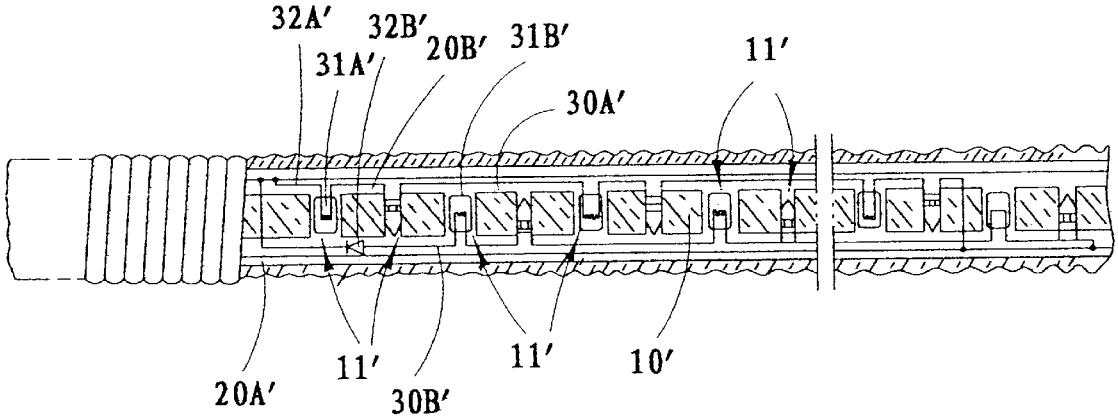
FIG. 7 is a sectional view of the chasing rope light according to a second preferred embodiment of the present invention.

Referring to FIG. 7, the chasing rope light 1 according to a second preferred embodiment of the present invention is illustrated, a plurality of cavities 11' are transversely and spacedly formed on the core tube 10', wherein the illuminators 31A', 31B' from two illuminating units 30A', 30B' are alternately and transversely disposed in the cavities 11'. In other words, when the illuminator 31A' of the first illuminating unit 30A' is transversely disposed in the cavity 11', the illuminator 31B' from the second illuminating unit 30B' is transversely disposed in the neighboring cavity 11', and so on. So, the core tube 10' is adapted for holding the illuminators 31' in position so as to prevent an unwanted lateral movement of the illuminating units 30'. The first and second alternative modes of the above first embodiment, as shown in FIGS. 5 and 6, can also be applied to the second embodiment by incorporating the core tube 10' as shown in FIG. 7.

What is claimed is:

1. A chasing rope light, comprising:

an elongated hollow core tube having an axial tubular cavity;

a first and a second conductive wire longitudinally extended along an outer circumference of said core tube;

a connector provided at one end of said core tube for electrically connecting said conductive wires to a power source;

a first and a second illuminating unit, each of which comprises a diode and at least an illuminator electrically connected together in series and is disposed in said tubular cavity of said core tube for securely holding said illuminators in position, wherein both first ends of said first and second illuminating units are electrically connected to said first conductive wire in parallel and both second ends of said first and second illuminating units are electrically connected to said second conductive wire in parallel, wherein said diode of said first illuminating unit and said other diode of said second illuminating unit are arranged in opposite direction that when a current is applied to said first and second conductive wires, said diode of said first illuminating unit enables said current flowing from said first conductive wire to said second conductive wire via said first illuminating unit, and said diode of said second illuminating unit enables said current flowing from said second conductive wire to said first conductive wire via said second illuminating unit, thereby said diodes of said first and second illuminating units allow opposite direction of said current flow into said illuminating units respectively; and an outer casing, which sealedly encircles said outer circumference of said core tube and sealedly covers said first and second conductive wires and said core tube to construct an elongated integral rope body to form said chasing rope light.

2. A chasing rope light, as recited in claim 1, wherein said core tube is made of flexible material and each of said illuminators is a LED.

* * * * *